US005590835A

United States Patent [19]

Rosenthal et al.

[11] Patent Number: 5,590,835

[45] Date of Patent: Jan. 7, 1997

[54] ATOMIZATION ATTACHMENT FOR A LIQUID CONTAINER

[75] Inventors: Karl-Heinz Rosenthal, Reichshof-Oberagger; Tom Kitzing, Wiehl-Weiershagen, both of Germany

[73] Assignee: AptarGroup S.A., Saint Germain en Laye, France

[21] Appl. No.: 630,561

[22] Filed: Apr. 10, 1996

Related U.S. Application Data

[63] Continuation of Ser. No. 298,135, Aug. 30, 1994, abandoned.

[30] Foreign Application Priority Data

Sep. 2, 1993 [DE] Germany ..... 43 29 707.2

[51] Int. Cl.[6] ..... B05B 9/043

[52] U.S. Cl. ..... 239/333; 239/337

[58] Field of Search ..... 239/320, 329, 239/333, 487, 489, 570, 321, 322, 331; 222/319–321

[56] References Cited

U.S. PATENT DOCUMENTS

| | | | |
|---|---|---|---|
| 904,149 | 11/1908 | Rachmann | 239/489 |
| 1,707,425 | 4/1929 | Baker | 239/322 |
| 1,926,367 | 9/1933 | Booth | 222/320 |
| 2,550,210 | 4/1951 | Vance, Jr. | 222/320 |
| 3,406,909 | 10/1968 | Pfeiffer | 239/333 |
| 3,768,733 | 10/1973 | Brenez | 239/331 |
| 4,175,704 | 11/1979 | Cohen | 239/320 |
| 4,244,525 | 1/1981 | Manna | 239/333 |
| 4,896,832 | 1/1990 | Howlett | 239/322 |
| 4,921,142 | 5/1990 | Graf et al. | 239/320 X |
| 5,257,726 | 11/1993 | Graf et al. | 222/320 |
| 5,284,132 | 2/1994 | Geier | 128/200.22 |

FOREIGN PATENT DOCUMENTS

| | | | |
|---|---|---|---|
| 452728 | 10/1991 | European Pat. Off. . | |
| 486894 | 5/1992 | European Pat. Off. . | |
| 2580956 | 10/1986 | France | 239/329 |
| 2668082 | 4/1992 | France . | |
| 3631341 | 4/1987 | Germany . | |
| 4016126 | 10/1991 | Germany . | |
| 91/15303 | 10/1991 | WIPO . | |

*Primary Examiner*—Lesley D. Morris
*Attorney, Agent, or Firm*—Dressler, Goldsmith, Milnamow & Katz, Ltd.

[57] ABSTRACT

The invention relates to an atomization attachment (10) for a liquid container (11), which is designed in an essentially cylindrical manner at least in an opening region (28), having an outer part (12) which is designed in the form of a cap, the head wall (26) of which is provided on the inside with a protrusion (25) and which can be pushed, by means of its opposite end provided with a container-receiving opening (27), over the opening region (28) of the liquid container (11) and can be displaced with respect to the same. An inner part (13) exhibits a riser tube (14) which is designed as a piston rod and is provided, at its end which can be inserted into the liquid container (11), with a piston (15) and, in its head plate (17) which can be connected to the outer part (12), with a super-atmospheric-pressure valve (16). A valve space (20) formed between the super-atmospheric-pressure valve (16) of the inner part (13) and the head wall (26) of the outer part (12) is in liquid connection, via a swirl duct (22), to an outlet opening (23) arranged in the outer part (12). By axial displacement of the outer part (12) into the liquid container (11), fragrance samples can be discharged in a sensitive manner. The atomization attachment (10) can be reused (FIG. 1).

5 Claims, 2 Drawing Sheets

ATOMIZATION ATTACHMENT FOR A LIQUID CONTAINER

This is a continuation of application Ser. No. 08/298,135, filed Aug. 30, 1994, now abandoned.

The present invention relates to an atomization attachment for a liquid container, in particular for discharging perfume samples, whose opening region is designed in an at least essentially cylindrical manner, having a closure-cap-like outer part, whose head wall is provided on the inner side with a protrusion and whose opposite end is provided with a container-receiving opening for the opening region, it being possible to displace the outer part and liquid container with respect to one another, and having an inner part with a riser tube which is designed as a piston rod which is provided, at its end which can be inserted into the cylindrical opening region of the liquid container, with a piston and, at the opposite end, with a head plate to which there is assigned a superatmospheric-pressure valve, the head plate of the inner part being retained fixedly on the underside of the head wall of the outer part, and a valve space formed between the superatmospheric-pressure valve of the inner part and the head wall of the outer part being in liquid connection, via a swirl duct, with an outlet opening arranged in the outer part.

The known atomization devices, as are known, in particular, for perfume bottles and flacons, exhibit, owing to their functioning principle which differs from the atomization attachment according to the invention, a complex construction and are connected to the liquid container. Apart from the fact that the complex construction of the known atomization devices renders the assembly thereof more difficult, the fixed connection of the atomization device to the liquid container also constitutes an obstacle to efficient recycling of the liquid containers, which usually consist of glass.

The object of the present invention is to provide an atomization device which, by virtue of a simple construction, can be easily assembled and dismantled and can be reused and permits sensitive spraying of the container liquid, in particular of fragrance samples from perfume sample containers.

This object is achieved by an atomization attachment according to the teachings of the invention described in detail hereinafter.

The atomization attachment according to the invention is composed merely of two assembly parts, namely the inner part and the outer part, which can be connected in a simple manner to one another and can be positioned onto the opening region of the liquid container, the outer part ensuring closure of the liquid container by virtue of its cap-like design. The inner part exhibits a riser tube which is designed as a piston rod and is provided, at an end which can be inserted into the container opening, with a piston and, at the opposite end, with a head plate and a superatmospheric-pressure valve. In order to form a valve space between that end of the inner part which is provided with the superatmospheric-pressure valve and the head wall of the outer part, the inner part can be inserted into the outer part. In this arrangement, a press fit between the head wall of the outer part and the head plate, provided with the valve, of the inner part ensures a continuous, fixed connection of the two parts of the atomization attachment. Provided between the valve space and an outlet opening arranged in the outer part is a swirl duct which ensures that, when the outer part is displaced with respect to the liquid container and the inner part is thus forced, with its piston, against the surface of a liquid accommodated in the liquid container, said liquid passes in the riser tube, via the superatmospheric-pressure valve, into the valve space and, swirled in the swirl duct, is sprayed outwards through the outlet opening.

After the liquid container has been emptied, the atomization attachment can be removed therefrom and positioned onto a new liquid-filled container. The empty liquid container can, of course, also be refilled and then closed again by the atomization attachment or it can be given over to a recycling process.

The swirl duct provided in the transition from the valve space to the outlet opening can be designed in a different manner and may optionally be assigned to the outer part or the inner part. Preferably, the annular head plate, provided with the valve, of the inner part is provided with a swirl duct which leads radially outwards from the valve space. The swirl duct may be designed as a swirl-duct inset which, in the event of the swirl duct being assigned to the inner part, can be inserted in the head plate, provided with the valve, of the inner part.

The functionally appropriate configuration of the swirl duct, that is to say in particular the configuration of the flow cross-section, may likewise be carried out differently. In general, a sickle-star-shaped flow cross-section has proved successful, as is also known from the swirl-duct design in the case of conventional atomization devices.

It is also, of course, possible to provide a plurality of swirl ducts which, of the same or different designs, can be combined with one another in terms of flow in order to achieve particularly good atomization effects.

In a preferred embodiment of the atomization attachment, the outer part is provided on the inner side of its head wall with a protrusion which, with connection to the inner part, can be fixedly inserted into the valve space.

A particularly simple superatmospheric-pressure valve can be achieved by a slot valve. Said slot valve, which is provided preferably at the upper end of the riser tube, can form a unit with the inner part. In this arrangement, the elasticity of the atomization attachment manufactured from a flexible plastic is exploited, said elasticity permitting the slot borders to be forced apart in order to open the valve, when the superatmospheric pressure is applied in the riser tube. The valve may, of course, also be designed in a different manner, for example as a flap valve.

As supporting base, which prevents the inner part from tilting in the liquid container, use may be made, above the piston provided at the end of the riser tube, of a supporting ring, preferably made in one piece with the riser tube.

In order, upon actuation of the atomization attachment, to permit the outer part to slide on the liquid-container outer wall in as simple a manner as possible, said outer part may be provided, in its end provided with the container opening, with a sliding guide.

If the sliding guide of the atomization attachment according to the invention is provided with an axial stop for securing the outer part behind a closure border of the opening of the liquid container, then the atomization attachment is suitable for a miniaturization, in particular for use with a cylindrical perfume-sample container known per se. In this arrangement, the atomization attachment can be used for closing the perfume-sample container instead of a conventional cap closure, with the result that the non-actuated atomization attachment acts as a conventional closure cap. Furthermore, the atomization attachment serves, however, to discharge one or more samples of sprayed perfume.

When using the atomization attachment together with a perfume-sample container, it is advantageous if the outer part is provided with a fastening device for fastening on a piece of clothing, for example a retaining clip. Consequently, it is possible to carry a relatively large number of fragrant-sample containers provided with the atomization attachment on the piece of clothing in order thus to increase the rapid availability of the individual perfume samples during a presentation of fragrances.

A preferred exemplary embodiment of the atomization attachment according to the invention is illustrated in more detail hereinbelow with reference to the drawings, in which.

Figure 1:
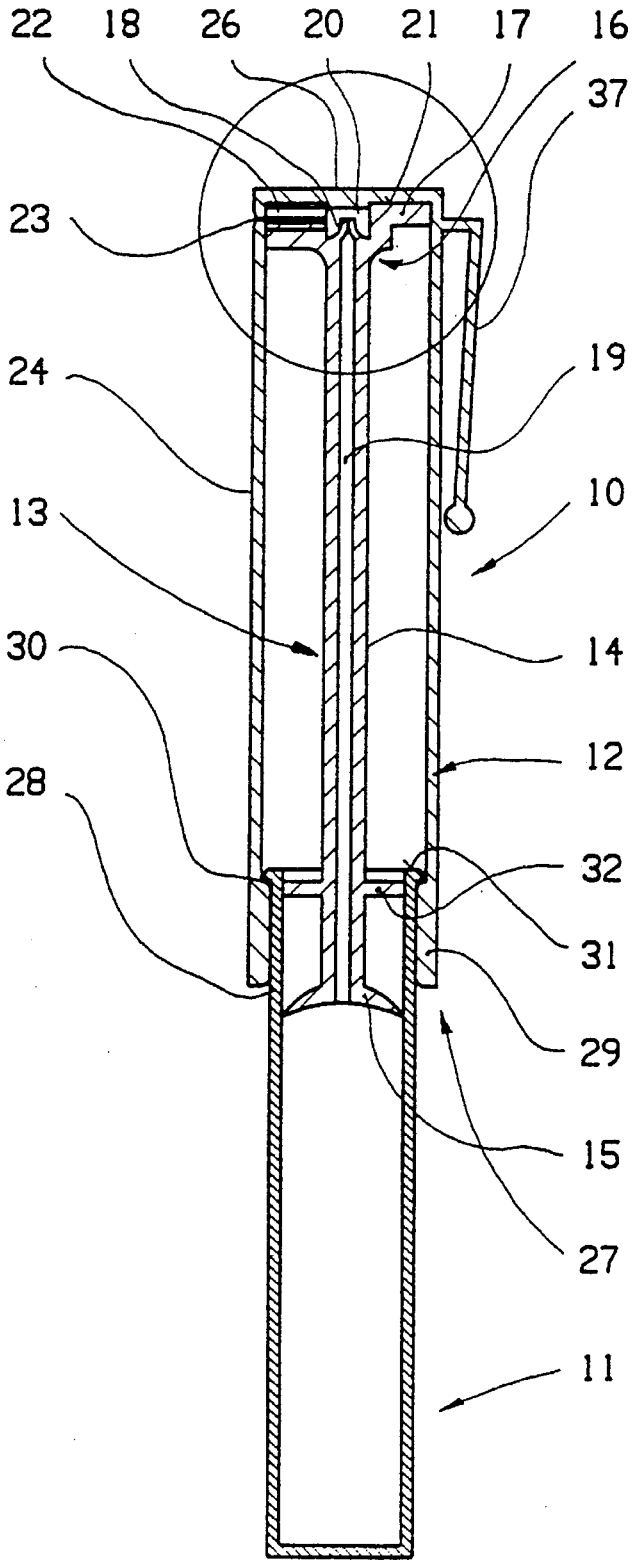
FIG. 1 shows an atomization attachment positioned on a perfume-sample container, before the actuation thereof.

FIG. 1 shows an embodiment of an atomization attachment 10 which is positioned on a sample container 11 which contains a perfume sample (not shown in any more detail). The atomization attachment 10 exhibits an outer part 12 and an inner part 13.

The inner part 13 is composed of a riser tube 14 which exhibits, at one inner end a piston 15, above which a supporting ring 32 is arranged at an axial distance. The inner part 13 is provided, at its opposite end, with a head plate 17 to which there is assigned a superatmospheric-pressure valve 16. The superatmospheric-pressure valve 16, the piston 15 and the supporting ring 31 are formed in one piece with the head plate 17 and riser tube 14.

The superatmospheric-pressure valve 16 is represented as a slot valve, whose slot borders 18 terminate the upper end of a riser-tube duct 19 in the riser tube 14 in a sealing manner. In order to form a valve space 20, the superatmospheric-pressure valve 16 is slightly axially set back, in the axial direction of the riser tube 14, with respect to an upper-side stop surface 21 of the head plate 17.

Running radially in the head plate 17 is a swirl duct 22 which forms a fluid connection between the valve space 20 and an outlet opening 23 in a wall which is formed here as a cylinder casing 24 and belongs to the outer part 12. For this purpose, the outer part 12 is aligned, with its outlet opening 23, coaxially with respect to the swirl duct 22. The swirl duct 22 is, in turn, an integral constituent part of the head plate 17; it may, however, also be composed of a pin which has a helical groove and is inserted into a radial outlet duct in the head plate 17.

In order to connect the inner part 13 to the outer part 12, the outer part 12 is inserted with a press fit, by means of a protrusion 25 on the inner side of its head wall 26, into an axial, upper opening 35 of the valve space 20 in the head plate 17 of the inner part 13. Furthermore, a press fit between the outer circumference of the annular head plate 17 and the cylindrical inner wall 36 of the outer part 12 is also preferably provided. If appropriate, the fixed connection between outer part 12 and inner part 13 can also be produced by adhesive bonding or welding.

That end of the outer part 12 which is opposite the head wall 26 is provided with a container-receiving opening 27, by means of which the outer part 12 can be positioned onto a cylindrical opening region 28 of the internally and externally cylindrical sample container 11. As FIG. 1 shows, the container-receiving opening 27 is slightly set back, axially, with respect to the piston 15 in order to facilitate positioning of the atomization attachment 10 onto the sample container 11.

The outer part 12 is provided, in the region of its container-receiving opening 27, with a sliding guide 29 which, in the case of the exemplary embodiment represented in FIG. 1, is designed as a thickened cylinder coating at the lower end of the outer part 12. Preferably, the cylindrical inner wall of the cylinder casing 24 is provided with annular ribs (not shown) which rest slidably on the cylindrical surface of the sample container 11, in order to reduce the sliding friction between outer part 12 and sample container 11.

In order to secure the atomization attachment 10 and/or the outer part 12 on the opening region 28 of the sample container 11, the sliding guide 29 is provided with an inner annular shoulder 30 which serves as an axial stop and interacts with an outer closure border 31 of the sample container 11. As FIG. 1 shows, said inner annular shoulder 30 is arranged above the supporting ring 32 of the inner part 13, with the result that secure, radial supporting of the lower end of the atomization attachment 10 on the sample container 11, and thus satisfactory axial guidance of the same on the inner wall and outer wall of the sample container 11, are ensured.

A particularly simple assembly of the two-part atomization attachment 10 consists in first of all inserting the inner part 13 into the outer part 12, by means of the head plate 17, until the protrusion 25 engages into the opening 35 to provide the fixed connection of inner part and outer part. It is only after this assembly of the atomization attachment that the latter is positioned onto the sample container. Since the piston 15 juts out downwards, the latter is inserted first of all into the opening of the sample container 11, with the result that the atomization attachment is centered with respect to the sample container. Thereafter, the lower end of the sliding guide 29 is pushed onto the opening region 28 until the annular shoulder 30 latches in beneath the closure border 31 of the sample container 11.

At the same time as this latching-in procedure, or thereafter, the connection, by means of a press fit or the like, between the head wall 26 of the outer part 12 and the head plate 17 of the inner part 13 is produced. In this arrangement, the protrusion 25 of the head wall 26 penetrates into the axial opening 35 of the valve space 20 in the inner part 13, with the result that a fluid connection between the swirl duct 22 of the inner part 13 and the outlet opening 23 of the outer part 12 is ensured.

In order to keep the sample container 11 at the ready, said container being closed, as represented in FIG. 1, by the atomization attachment 10 in its initial position, said sample container 11, together with the atomization attachment, can be fastened on a piece of clothing via a retaining clip 37 provided on the outer part 12 of the atomization attachment 10.

Figure 2:
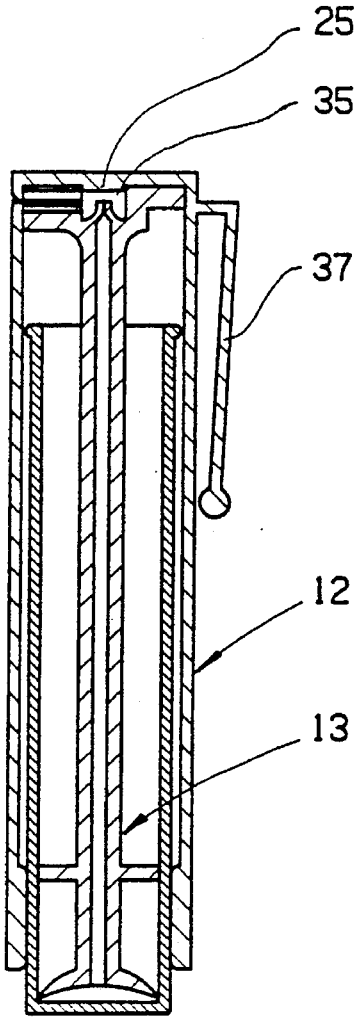
FIG. 2 shows the atomization attachment represented in FIG. 1, after the actuation thereof.

In order to carry out the atomization function, the sample container 11, represented in FIG. 1 and closed by the atomization attachment 10, can be held between thumb and forefinger, the forefinger exerting, on the head wall 26, a pressure which effects a transfer of the atomization attachment 10 into that position with respect to the sample container 11 which is represented in FIG. 2. This sliding movement, in the case of which the sliding guide 29 of the outer part 12 slides along on the outer wall of the sample container 11, can be carried out continuously in order to discharge the entire contents of the sample container or it can be divided into part-movements in order to discharge metered quantities of the contents of the sample container.

The pressure applied on the head wall 26 of the outer part 12 is transferred, by the piston 15, to the surface of the liquid accommodated in the sample container 11, and it causes the liquid to rise up in the riser-tube duct 19 as far as the superatmospheric-pressure valve 16. Upon reaching a swirling-pressure value, given in dependence on the elasticity of the slot borders 18, the slot borders 18 are forced apart, in order to release a valve slot 38, and the liquid penetrates into a valve space 20 which, already, causes swirling of the liquid as a result of the arrangement and form of the slot valve and of the valve space. The liquid then flows into the swirl duct 22, in which swirling of the liquid takes place before it is discharged out of the outlet opening 23. During the axial displacement of the inner part 13 into the sample container 11, the supporting ring 32 ensures that the piston 15 remains in its position, which is essentially horizontal in FIGS. 1 and 2, and the piston borders rest in an elastically sealing manner on the inner wall of the container.

Figure 3:
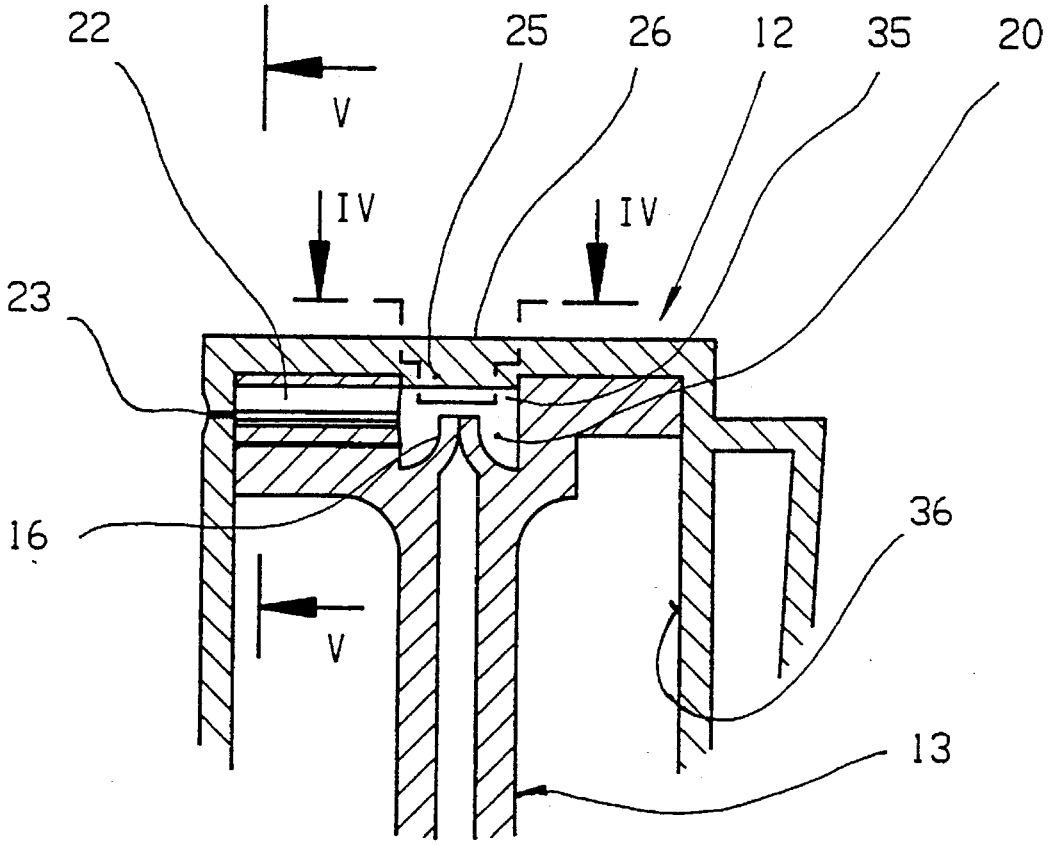
FIG. 3 shows, on an enlarged scale, that region of the atomization attachment which is circled in FIG. 1.
Figure 4:
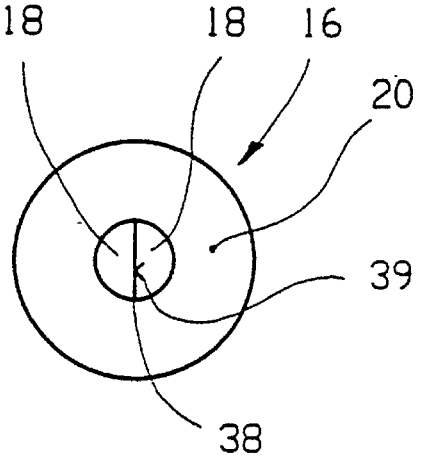
FIG. 4 shows a sectional view of the atomization-attachment region represented in FIG. 3, along the section line IV—IV.
Figure 5:
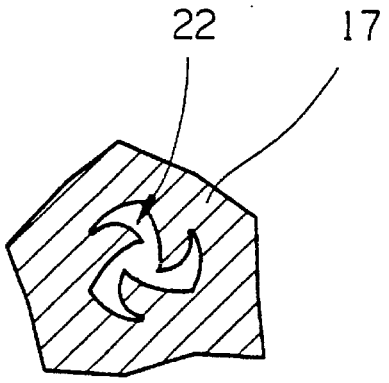
FIG. 5 shows a sectional view of the atomization-attachment region represented in FIG. 3 in accordance with the section line V—V.

FIG. 3 shows, on an enlarged scale, that region of the atomization attachment 10 which is circled in FIG. 1 and through which the sections represented in FIGS. 4 and 5 are taken.

FIG. 4 shows the superatmospheric-pressure valve 16 in a plan view, it being possible to see into the valve space 20 and clearly recognize the slot borders 18 of the slot valve 16 which, when the valve slot 38 is closed, rest in a sealing manner against one another by means of their contact surfaces 39, arranged approximately perpendicularly with respect to the plane of the drawing.

FIG. 5 shows a sickle-star-shaped design, known per se, of the flow cross-section of the swirl duct 22 which is provided in the head plate 17 of the inner part 13. The sickle-star-shaped and, if appropriate, additionally helical configuration of the swirl-duct cross-section through which flow takes place ensures, as a result of an acceleration of liquid particles in the border regions of the swirl duct 22, that said liquid particles are swirled, with the result that these can be discharged in atomized form through the outlet opening 23 which is provided in the bordering outer part 12 (FIG. 3) and is designed as a simple through-passage bore.

We claim:

1. An atomization attachment (10) for a liquid container (11) suitable for discharging, inter alia, perfume samples wherein said container (11) is generally cylindrical and defines an upper end opening region (28), said attachment comprising:

(A) a closure-cap-like outer part (12) having a head wall (26) at one end defining an inner side and having an opposite end defining a container-receiving opening (27) for the container upper end opening region (28) whereby relative displacement may be effected between said outer part (12) and said container (11), and (B) an inner part (13) with a riser tube (14) in the form of a piston rod having a distal end with a piston (15) which can be inserted into said container upper end opening region (28), said piston rod having an end opposite said piston (15) with a head plate (17) and a superatmospheric-pressure valve (16) carried in said head plate (17), the head plate (17) of the inner part (13) being retained fixedly on said inner side of said head wall (26) of the outer part (12), said inner part (13) and outer part 12 together defining a valve space (20) between the superatmospheric-pressure valve (16) of the inner part (13) and the head wall (26) of the outer part (12), said outer part (12) defining an outlet opening (23) establishing flow communication with said valve space (20), said inner part (13) head plate (17) defining an opening (35), and said outer part (12) including a protrusion (25) which is on said inner side of said head wall (26) and which is press-fitted into said opening (35) to retain said inner part (13) fixedly on said outer part (12).

2. An atomization attachment (10) for a liquid container (11) suitable for discharging, inter alia, perfume samples wherein said container (11) is generally cylindrical and defines an upper end opening region (28), said attachment comprising:

(A) a closure-cap-like outer part (12) having a head wall (26) at one end defining an inner side and having an opposite end defining a container-receiving opening (27) for the container upper end opening region (28) whereby relative displacement may be effected between said outer part (12) and said container (11), and (B) an inner part (13) with a riser tube (14) in the form of a piston rod having a distal end with a piston (15) which can be inserted into said container upper end opening region (28), said piston rod having an end opposite said piston (15) with a head plate (17) and a superatmospheric-pressure valve (16) carried in said head plate (17), the head plate (17) of the inner part (13) being retained fixedly on said inner side of said head wall (26) of the outer part (12), said inner part (13) and outer part 12 together defining a valve space (20) between the superatmospheric-pressure valve (16) of the inner part (13) and the head wall (26) of the outer part (12), said outer part (12) defining an outlet opening (23) establishing flow communication with said valve space (20), said piston rod (14) of the inner part (13) being provided with a supporting ring (32) at a distance above the piston (15), said supporting ring (32) being located between said head plate (17) and said piston (15).

3. An atomization attachment (10) for a liquid container (11) suitable for discharging, inter alia, perfume samples wherein said container (11) is generally cylindrical and defines an upper end opening region (28), said attachment comprising:

(A) a closure-cap-like outer part (12) having a head wall (26) at one end defining an inner side and having an opposite end defining a container-receiving opening (27) for the container upper end opening region (28) whereby relative displacement may be effected between said outer part (12) and said container (11) to define an unactuated position and a fully actuated position, and (B) an inner part (13) with a riser tube (14) in the form of a piston rod having a distal end with a piston (15) which can be inserted into said container upper end opening region (28), said piston rod having an end opposite said piston (15) with a head plate (17) and a superatmospheric-pressure valve (16) carried in said head plate (17), the head plate (17) of the inner part (13) being retained fixedly on said inner side of said head wall (26) of the outer part (12), said inner part (13) and outer part 12 together defining a valve space (20) between the superatmospheric-pressure valve (16) of the inner part (13) and the head wall (26) of the outer part (12), said outer part (12) defining an outlet opening (23), said outer part (12) being provided, at its end defining the container-receiving opening (27), with a sliding guide (29), said sliding guide (29) protecting radially inwardly from said opening (27) and residing adjacent the bottom of the container (11) when the attachment (10) is in said fully actuated position.

4. The atomization attachment as claimed in claim 3 wherein the sliding guide (29) is provided with an annular shoulder (30) for securing the outer part (12) behind a part of the liquid container (11).

5. The atomization attachment as claimed in claim 4, wherein the outer part (12) is provided with a retaining clip (37).

* * * * *